US006199965B1

(12) United States Patent
Kanbe et al.

(10) Patent No.: US 6,199,965 B1
(45) Date of Patent: Mar. 13, 2001

(54) COMMODITY STORAGE APPARATUS PERMITTING READY SUPPLEMENT OF COMMODITIES

(75) Inventors: Tooru Kanbe, Ohta; Nariaki Kojima, Isesaki, both of (JP)

(73) Assignee: Sanden Corporation (JP)

( * ) Notice: Subject to any disclaimer, the term of this patent is extended or adjusted under 35 U.S.C. 154(b) by 0 days.

(21) Appl. No.: 09/443,289

(22) Filed: Nov. 23, 1999

(30) Foreign Application Priority Data

Nov. 24, 1998 (JP) ..... 10-332275

(51) Int. Cl.[7] ..... A47B 88/18
(52) U.S. Cl. ..... 312/334.1; 312/322
(58) Field of Search ..... 312/334.1, 334.4, 312/333, 322, 323, 119, 120, 122, 123, 126, 330.1, 334.7, 334.44; 211/59.2

(56) References Cited

U.S. PATENT DOCUMENTS 1,189,371 * 7/1916 Lyons ..... 312/322 X
2,769,551 * 11/1956 Just ..... 312/333 X
4,314,734 * 2/1982 Grunert ..... 312/333 X
4,809,855 3/1989 Bustos ..... 211/59.2
5,306,077 * 4/1994 Trevaskis ..... 312/122
5,599,079 * 2/1997 Ranno et al. ..... 312/323

FOREIGN PATENT DOCUMENTS 24 02 376 7/1975 (DE) .
2286576 8/1995 (GB) .
9-106476 4/1997 (JP) .

* cited by examiner

*Primary Examiner*—James O. Hansen
(74) *Attorney, Agent, or Firm*—Banner & Witcoff, Ltd.

(57) ABSTRACT

In a commodity storage apparatus having a shelf (12) for housing commodities, the shelf is supported by a fixedly installed apparatus frame (11) so as to be movable between a forward position and a backward position. Responsive to movement of the shelf between the forward and the backward positions, an attitude control arrangement controls an attitude of the shelf in a predetermined plane extending in a forward and rearward direction and a vertical direction. It is preferable that a rear end portion of the shelf moves between a relatively higher position and a relatively lower position in accordance with the movement of the shelf.

10 Claims, 9 Drawing Sheets

COMMODITY STORAGE APPARATUS PERMITTING READY SUPPLEMENT OF COMMODITIES

BACKGROUND OF THE INVENTION

The present invention relates to a commodity storage apparatus suitable for a vending machine which permits to drop forwardly, for example, predetermined packaged commodities for carrying out or delivery of the packaged commodities.

A conventional commodity storage apparatus is shown in Japanese Patent Publication (Unexamined) No. 9-106,476. The conventional commodity storage apparatus comprises an apparatus frame, a plurality of shelves arranged in a vertical direction to space with each other and fixed to the apparatus frame, and a plurality of delivery mechanisms placed at forward ends of the shelves, respectively. Each shelf has a forwardly slant portion and houses commodities therein. Responsive to a vending signal known in the art, each delivery mechanisms makes each of the commodities be slid down forwardly one by one from each shelf. The commodities are supplied from a front face of the commodity storage apparatus to the shelves, respectively.

In the conventional commodity storage apparatus described above, there is a serious problem that the commodities must be inserted through a relatively narrow and small space of the shelves, resulting in deficiency in workability of supplement of commodities. This is because the shelves are fixed to the apparatus frame.

An attempt was made to provide shelves, each of which can be drawn along a forward inclination so that supplement of commodities can be conducted readily. In the attempt, however, there is another problem that when each shelf is drawn forwardly toward a working personnel, a weight or load of each shelf is partly added to the working personnel to thereby provide some defects on the workability of commodity supplement. This is because each shelf has the inclined portion which inclines forwardly.

SUMMARY OF THE INVENTION

It is therefore an object of the present invention to provide a commodity storage apparatus, which permits ready supplement of commodities into a predetermined position of a shelf.

Other objects of the present invention will become clear as the description proceeds.

According to an aspect of the present invention, there is provided a commodity storage apparatus for storing commodities, comprising an apparatus frame fixedly installed, a shelf supported by the apparatus frame for housing the commodities, the shelf being movable between a forward position and a backward position, and attitude control means connected to the apparatus frame and the shelf and responsive to movement of the shelf between the forward and the backward positions for controlling an attitude of the shelf in a predetermined plane extending in a fore and aft direction and a vertical direction.

According to another aspect of the present invention, there is provided a commodity storage apparatus comprising a shelf for housing commodities in a back and forth alignment relation, an apparatus frame supporting the shelf in a forwardly inclined relation, the shelf being drawable in a forward direction of the apparatus frame, and attitude control means connected to the shelf and the apparatus frame and responsive to movement of the shelf in the forward direction for controlling an attitude of the shelf in such a manner that a rear end of the shelf is descended when the shelf is moved in a forward direction and that the rear end of the shelves is ascended when the shelf is moved in a backward direction.

DESCRIPTION OF THE PREFERRED EMBODIMENT

Figure 1:
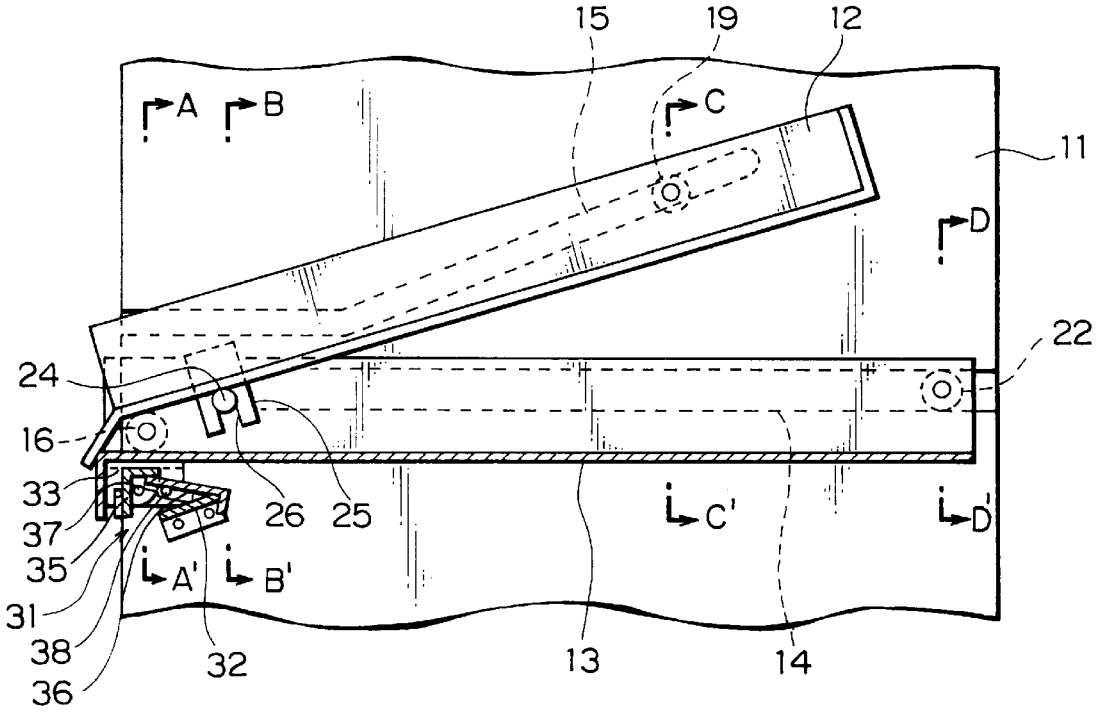
FIG. 1 is a schematic side view of a part of a commodity storage apparatus for a vending machine according to a first embodiment of the invention.
Figure 2A:
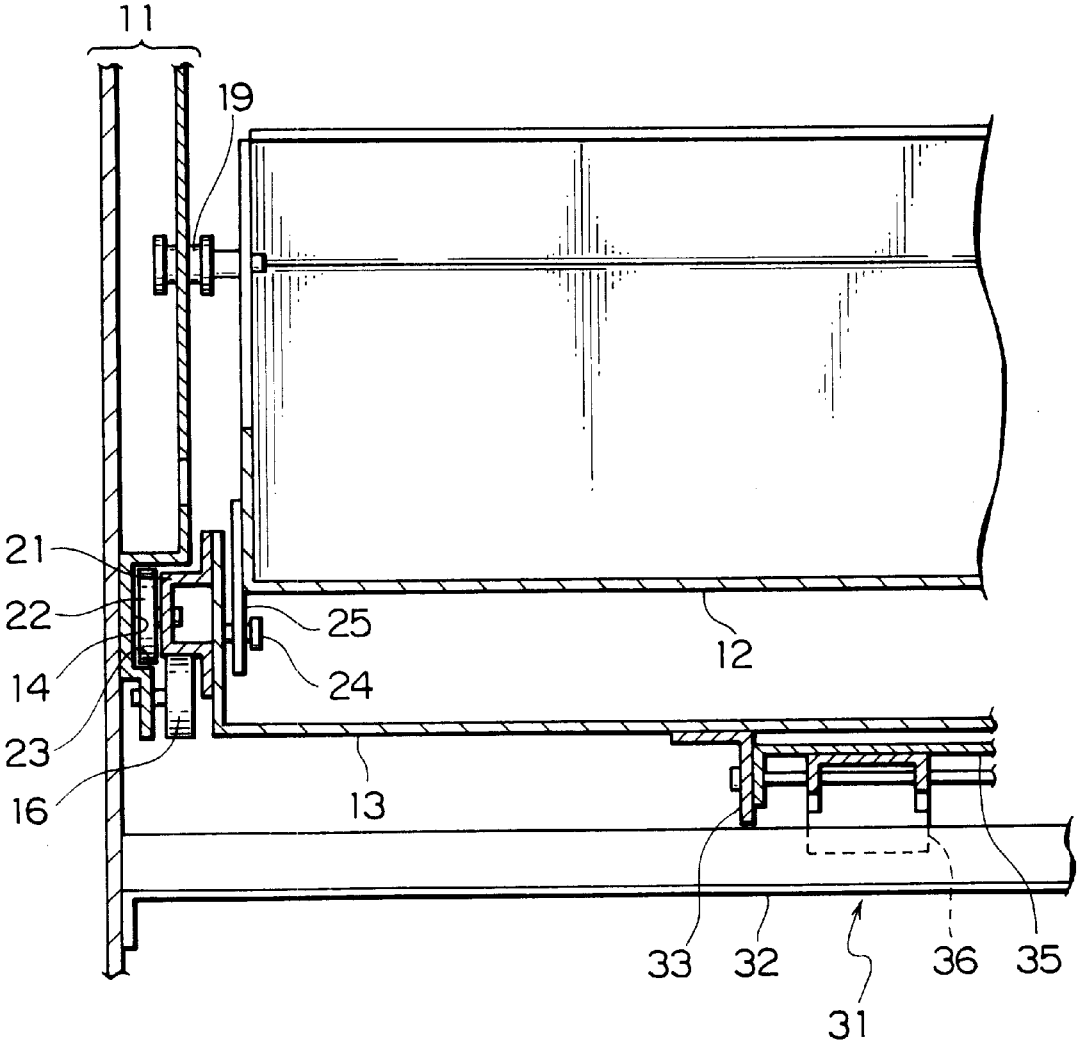
FIG. 2A is an enlarged sectional view taken along a line A–A' in FIG. 1.
Figure 2B:
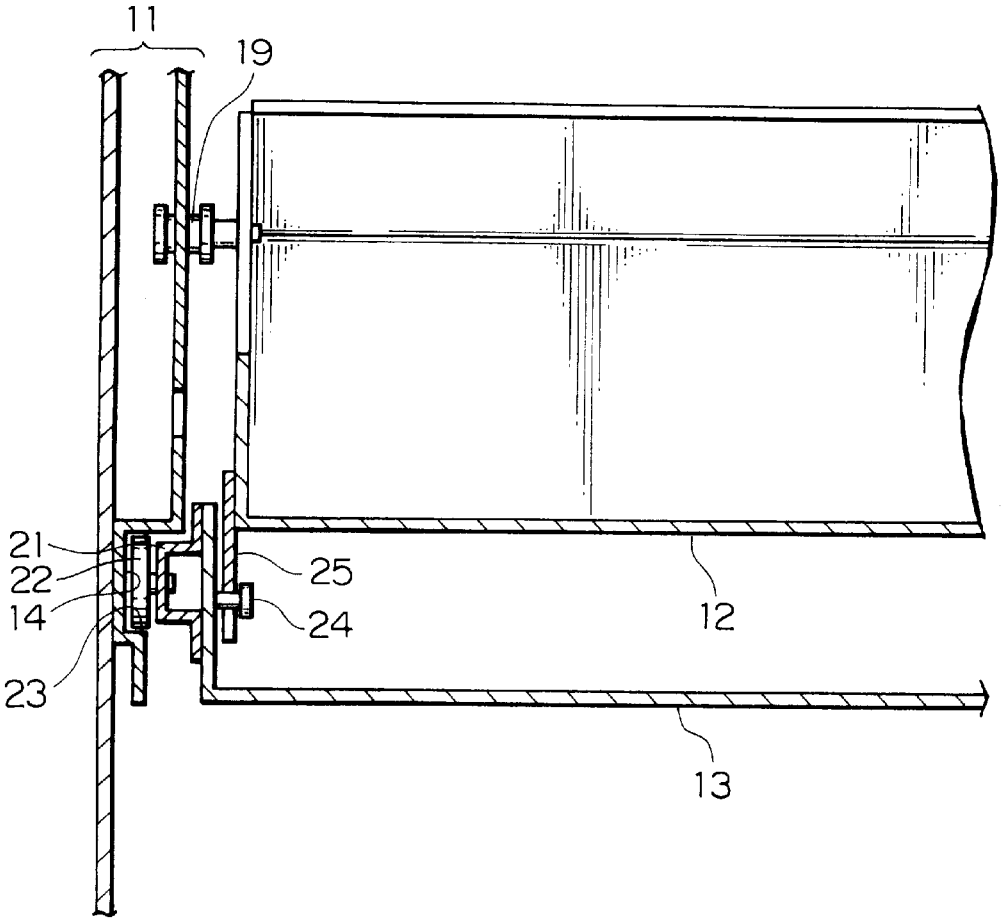
FIG. 2B is an enlarged sectional view taken along a line B–B' FIG. 1.
Figure 2C:
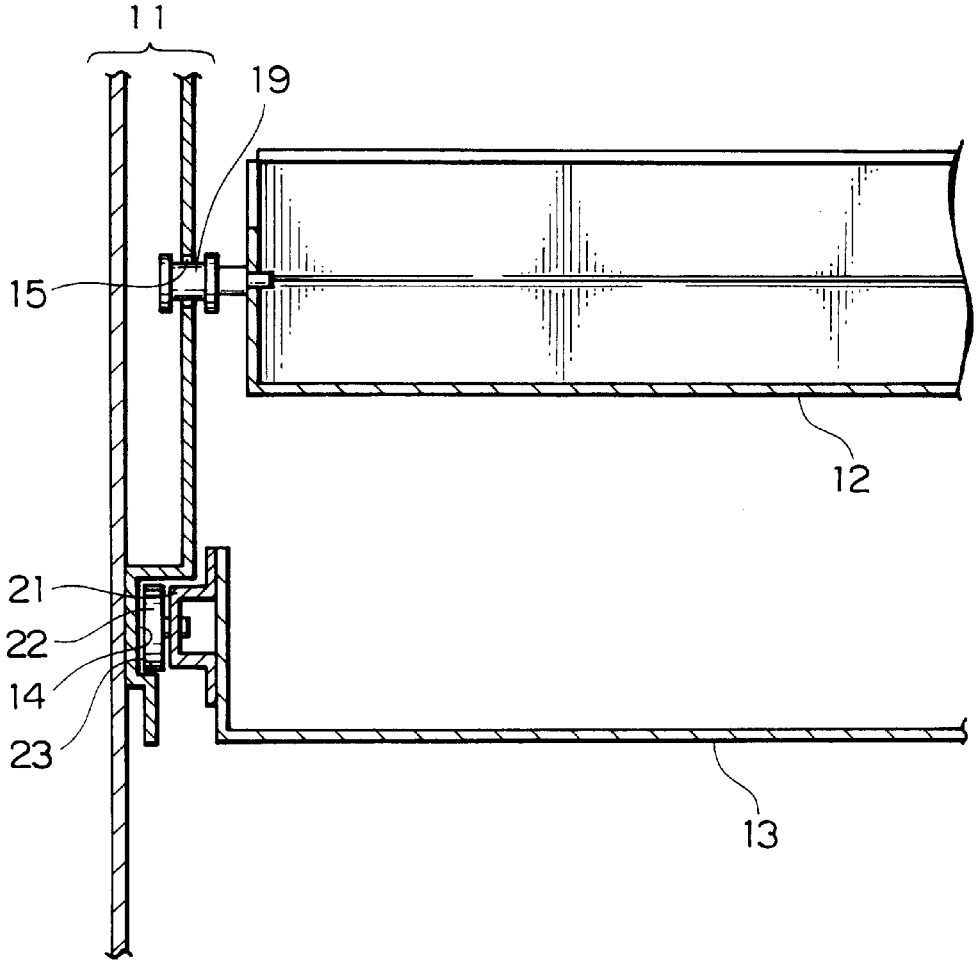
FIG. 2C is an enlarged sectional view taken along a line C–C' in FIG. 1.
Figure 2D:
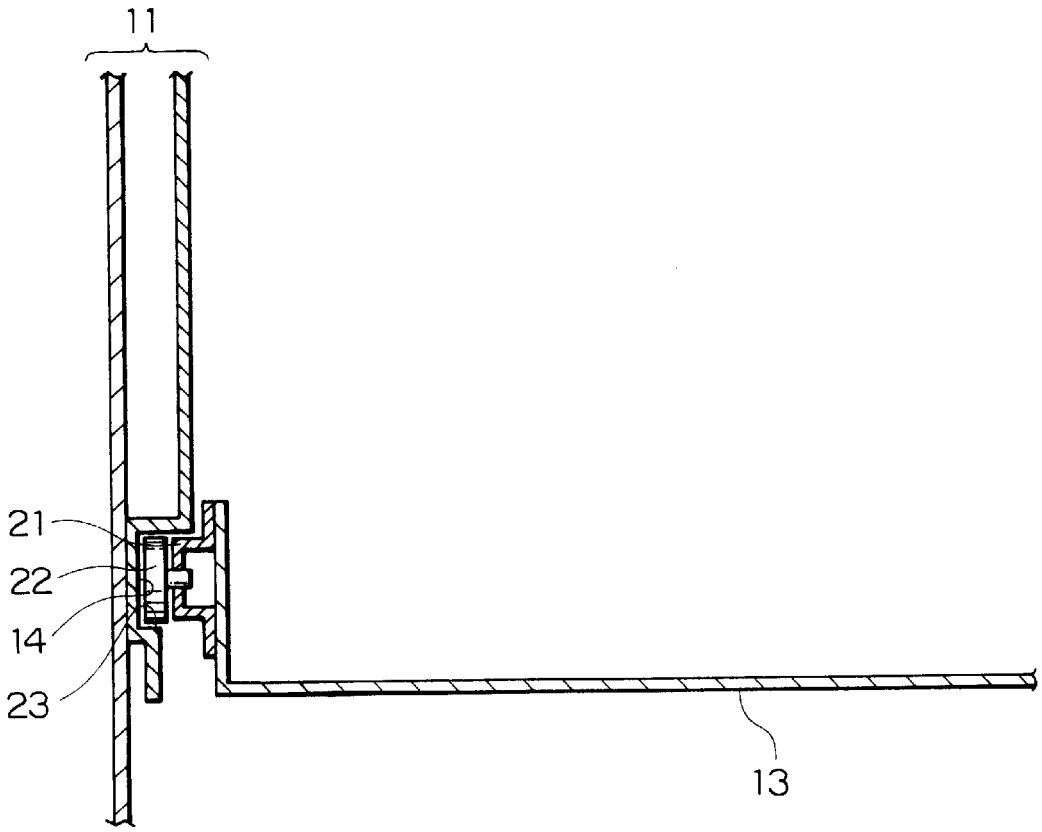
FIG. 2D is an enlarged sectional view taken along a line D–D' in FIG. 1.

With reference to FIGS. 1–4, description will be made as regards a commodity storage apparatus according to a first embodiment of the invention.

In FIGS. 1 and 2A–2D, the commodity storage apparatus is used for a vending machine known in the art and comprises a pair of side plates (only one of which is illustrated) 11 which are opposite to space together in a left and right direction. Each of the side plates 11 extends parallel to a predetermined plane defined by a fore and aft direction and a vertical direction. A combination of the side plates 11 is referred to as an apparatus frame.

The commodity storage apparatus further comprises a commodity shelf 12 for receiving commodities and a movable member or a slide member 13 supported by the side plates 11 to be movable in the fore and aft direction. The commodity shelf 12 is supported by the side plates 11 and the slide member 13 to have an attitude or posture controlled in the predetermined plane in the manner which will later be described.

Each side plate 11 has a first guide groove 14 for supporting the slide member 13 and a second guide groove 15 for supporting the commodity shelves. The first guide groove 14 is formed in a linear configuration and extends in the fore and aft direction. At a front portion of each side plate 11, a roller 16 is rotatably attached under the first groove 14. The second guide groove 15 which is formed in a linear configuration and has a first part extending in a fore and aft direction and a second part downwardly inclined in the front direction. It is to be noted that the second part of the second guide groove 15 extends in an oblique direction intersecting the fore and aft direction and the vertical direction.

On the both side portions of the rear end of the shelf 12, flanged rollers (only one of which is illustrated) 19 are rotatably attached as a guided member. Each roller 19 is rotatably engaged with the second guide groove 15 of the side plate 11. In the manner which will later be described, a delivery or carrying out mechanism is provided to the front end of the commodity shelf 12 for carrying out the commodities to the front portion of the apparatus. A combination of the second guide groove 15 and the roller 19 will be referred to as a rear guiding arrangement.

The slide member 13 is formed slightly wider than the width of the commodity shelf 12 and positioned at a lower portion of the commodity shelf 12. The slide member 13 is fixed on its both side surfaces with guide projections (only one of which is illustrated) 21 extending in the fore and aft direction and with rollers 22 (only one of which is illustrated) rotatably attached to the rear end portion of the guide projections 21. Each roller 22 is engaged with the first guide groove 14 of the side plate 11. In other words, the roller 22 is supported on a guide rail 23 formed by the first guide groove 14 and is rotated on the guide rail 23. Each guide projection 21 is supported by the roller 16 attached to the side plate 11.

The slide member 13 is fixed on its both sides of the front end portion with pins (only one of which is illustrated) 24 for supporting the front end portion of the commodity shelf 12. On the other hand, the shelf 12 is fixed on its both sides of the front end portion with coupling plate (only one of which is illustrated) 25 each having a groove 26 opened downwardly. Each pin 24 is pivotally engaged with the groove 26 of each coupling plate 25. Therefore, the shelf 12 is rotatably supported around the pins 24. A combination of the pins 24 and the coupling plates 25 will be referred to as a pivotal support arrangement. A combination of the slide member 13 and the pivotal support arrangement will be referred to as a front guiding arrangement. A combination of the front and the rear guiding arrangements is referred to as an attitude control arrangement.

The commodity storage apparatus further comprises a stopper 31 placed under the slide member 13 for stopping the commodity shelf 12 at the backward position. In the manner which will presently be described, the stopper 31 comprises an engaging plate 32, a fixing plate 33, a handle 35, and a lever 36. The stopper 31 extends between the side plates 11 in the left and right direction and is fixed to the side plates 11. The fixing plate 33 is fixed to a lower surface of the slide member 13. The handle 35 is pivotally attached to the fixing plate 33 through a first shaft 37. The lever 36 is pivotally attached to the fixing plate 33 through a second shaft 38 and extends between the handle 35 and the engaging plate 32.

When the slide member 13 is placed at the backward position as shown in FIG. 1, the lever 36 is engaged with the engaging plate 32 to prevent the slide member 13 from movement towards the forward position. Therefore, the commodity shelf 12 is stopped together with the slid member 13 at the backward position. When an operator attracts the handle 35, an end of the lever 36 is pushed down by a part of the handle 35. At the same time, another end of the lever 36 be moved upwardly. As a result, the lever 36 is released from the engaging plate 32. With this state, the slide member 13 can be readily moved together with the commodity shelf 12 towards the forward position by the operator. When the operator pushes the slide member 13 from the forward position to the backward position, the lever 36 becomes engaged with the engaging plate 32 after being guided by an upper surface of the engaging plate 32.

Figure 3A:
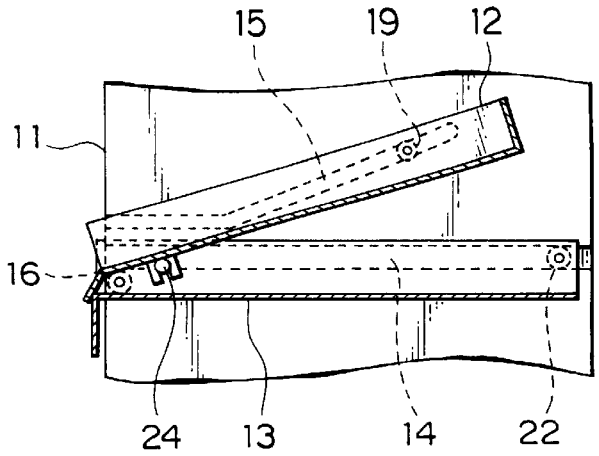
FIGS. 3A, 3B, and 3C are diagrams describing an operation of the commodity storage apparatus of FIG. 1.
Figure 3B:
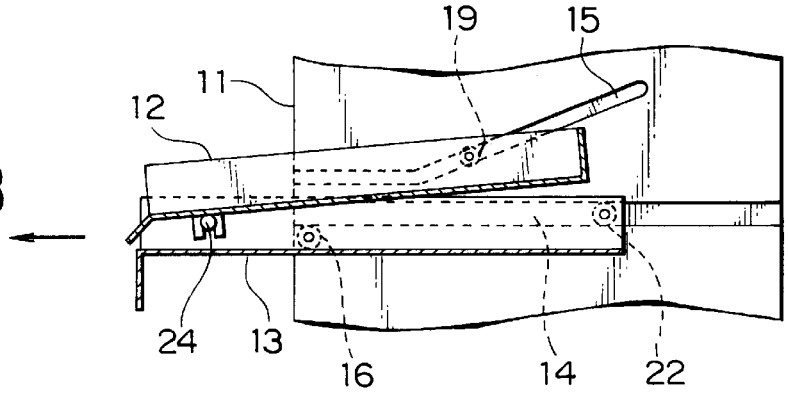
Figure 3C:
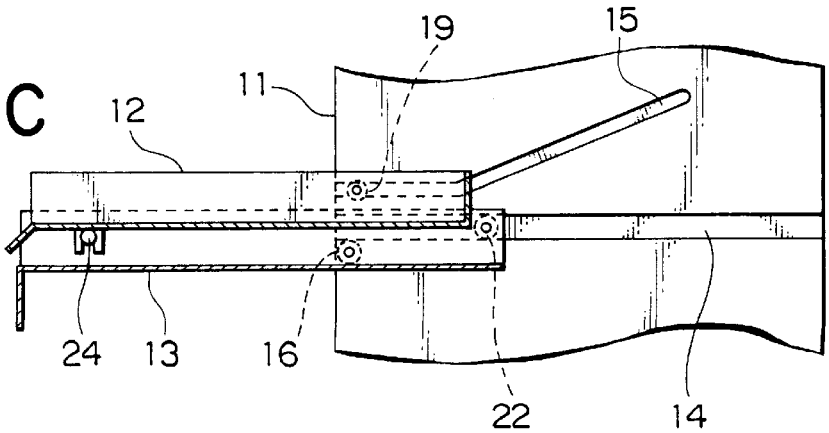

In the commodity storage apparatus described above, when the commodity shelf 12 is accommodated between the side plates 11 as shown FIG. 3A, each roller 19 is positioned at a rear end of the second guide groove 15, that is, at the inclined portion of the second guide groove 15. Therefore, the shelf 12 is held in a forwardly inclined posture or attitude at a backward position. Then, when the slide member 13 is pulled or drawn forwardly to be placed at a backward position as shown in FIG. 3B, the slide member 13 is moved forward together with the commodity shelf 12. In this event, each roller 19 is moved along the inclined portion of the second guide groove 15 toward the front end. Thus, the rear end portion of the shelf 12 is lowered or descended until each roller 19 arrives at the front end portion of the second guide groove 15, where the shelf 12 is placed in a horizontal state as shown in FIG. 3C.

With the commodity storage apparatus, the commodity shelf 12 is forwardly movably supported by the slide member 13 which is slidable in the fore and aft direction. In addition, when the slide member 13 is moved in the forward direction, the rear end portion of the commodity shelf 12 is descended to be placed at a relatively lower position. When the slide member 13 is moved in the rearward direction, the rear end of the shelf 12 is ascended to be placed at a relatively higher position. Therefore, when the slide member 13 is drawn or pulled in the forward direction for the purpose of supplementing the commodities, the commodity shelf 12 is held in a horizontal posture or attitude. This will permit an extremely easy supplement of the commodities. In this case, since the slide member 13 is moved in the horizontal direction, a weight of the commodity shelf 12 does not affect in the inclination direction of the shelf 12. Thus, it is possible to operate or move the slide member 13 in the fore and aft directions with a very small force of the working personnel.

Figure 4A:
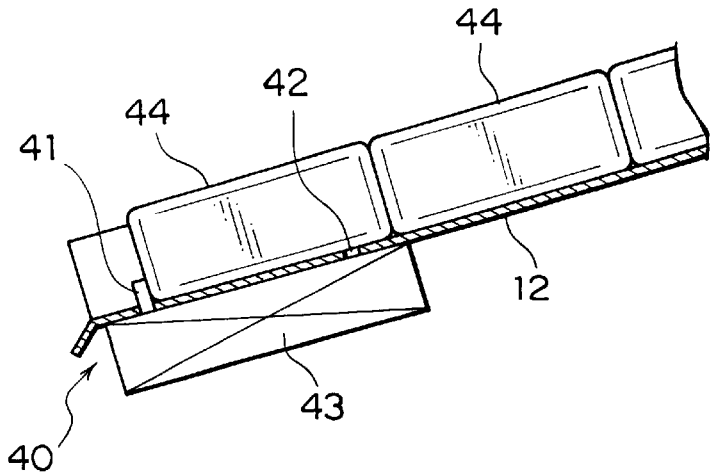
FIGS. 4A, 4B, and 4C are side views describing an operation of a delivery mechanism which is for delivering commodities one by one from a shelf included in the commodity storage apparatus of FIG. 1.
Figure 4B:
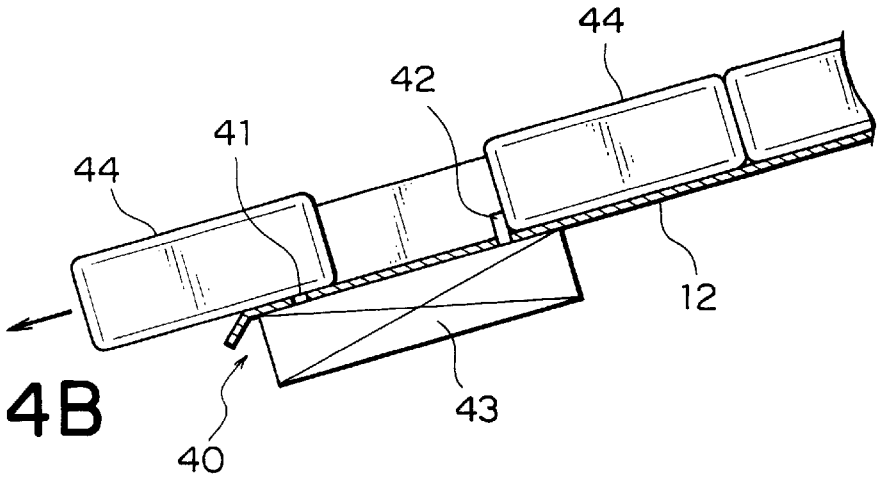
Figure 4C:
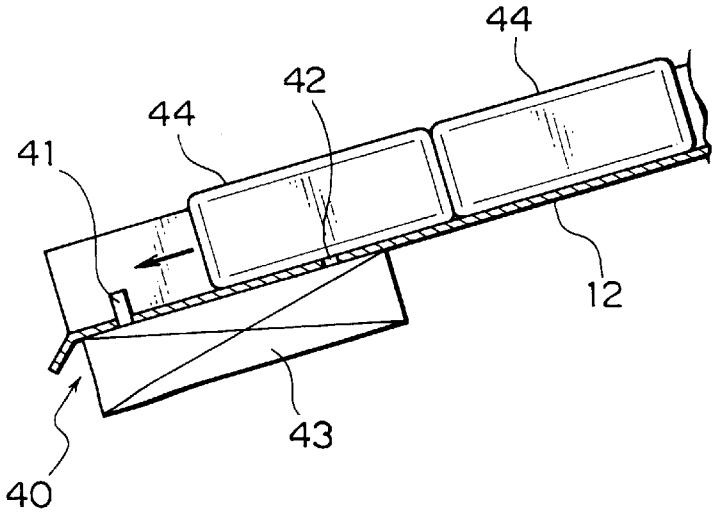

With reference to FIGS. 4A–4C, the description will be made as regards the delivery or carrying out mechanism depicted by a reference numeral 40. Similar parts are designated by like reference numerals.

The carrying-out mechanism 40 has a pair of take-out members 41 and 42 which are depressibly disposed, in a back and forth alignment (front and back rows) relation, on the bottom surface of the commodity shelf 12, and driving portion 43 for selectively depressing the take-out members 41 and 42. Each of the take-out members 41 and 42 serves to engage or hold commodities 44 placed on the shelf 12. In other words, in a stand-by condition for a carrying-out operation, only the take-out member 41 of the front row is projected on the shelf 12 as illustrated in FIG. 4A. In this state, the commodity 44 of the front row is engaged with and held by the take-out member 41. When a carrying-out operation starts, the take-out member 41 of the front row is depressed, as shown in FIG. 4B. At the same time, the take-out member 42 of the back row is projected on the shelf 12.

With this mechanism, only the commodity 44 of the front row is slidingly moved in the forward direction and dropped for a carrying-out operation. The following commodity 44 is engaged with and held by the other take-out member 42 of the back row. Then, the take-out member 41 of the front row is projected as shown in FIG. 4C, the take-out member 42 of the back row being depressed. Therefore, the commodity 44 on the shelf 12 is then engaged with the take-out member 42 of the front row to proceed back to the stand-by condition shown in FIG. 4A. It should be appreciated that this is only an example of the carrying-out mechanism and the other mechanisms and operations can be available if necessary.

Figure 5:
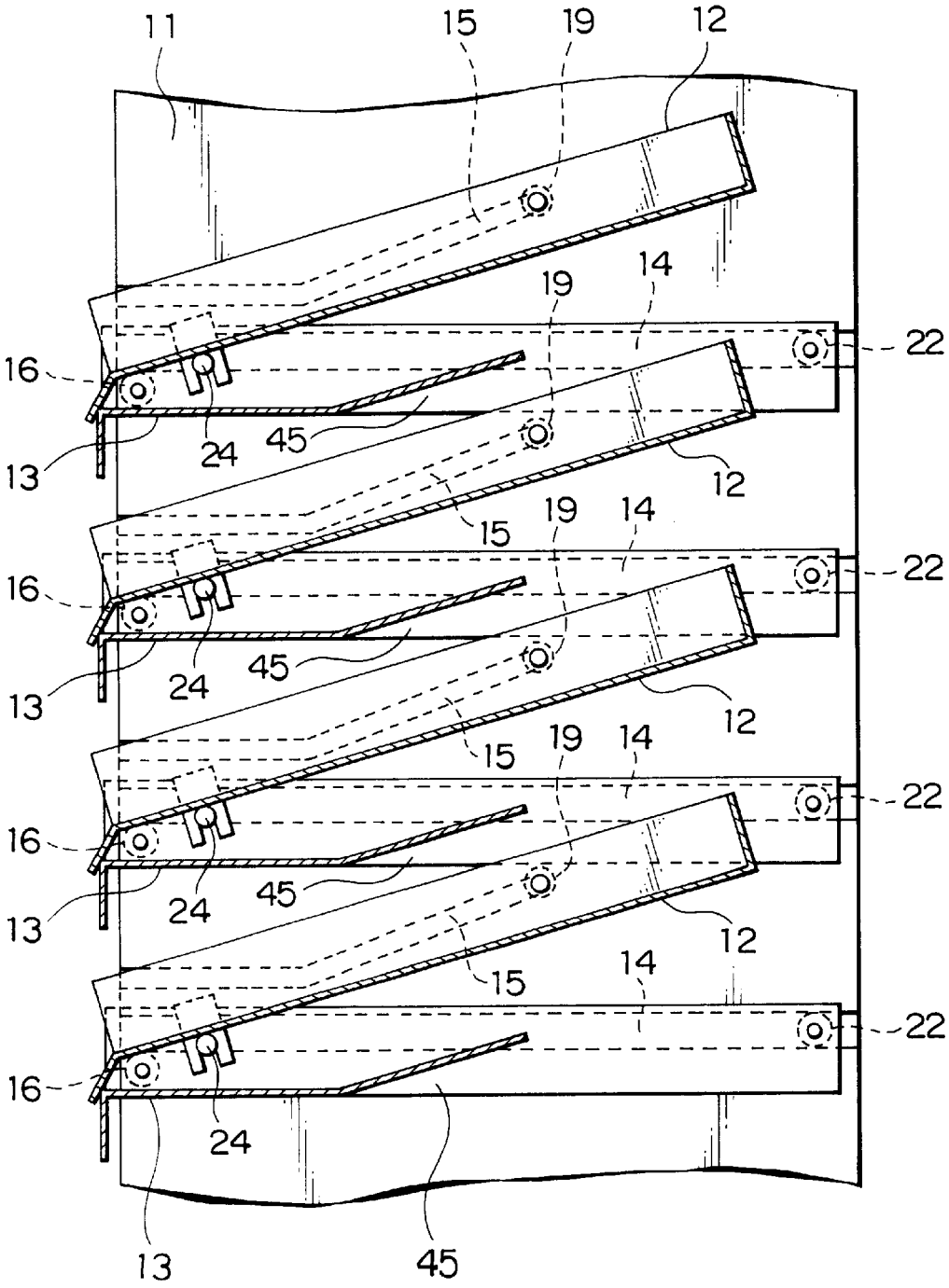
FIG. 5 is a schematic side view of a commodity storage apparatus according to a second embodiment of the invention.
Figure 6:
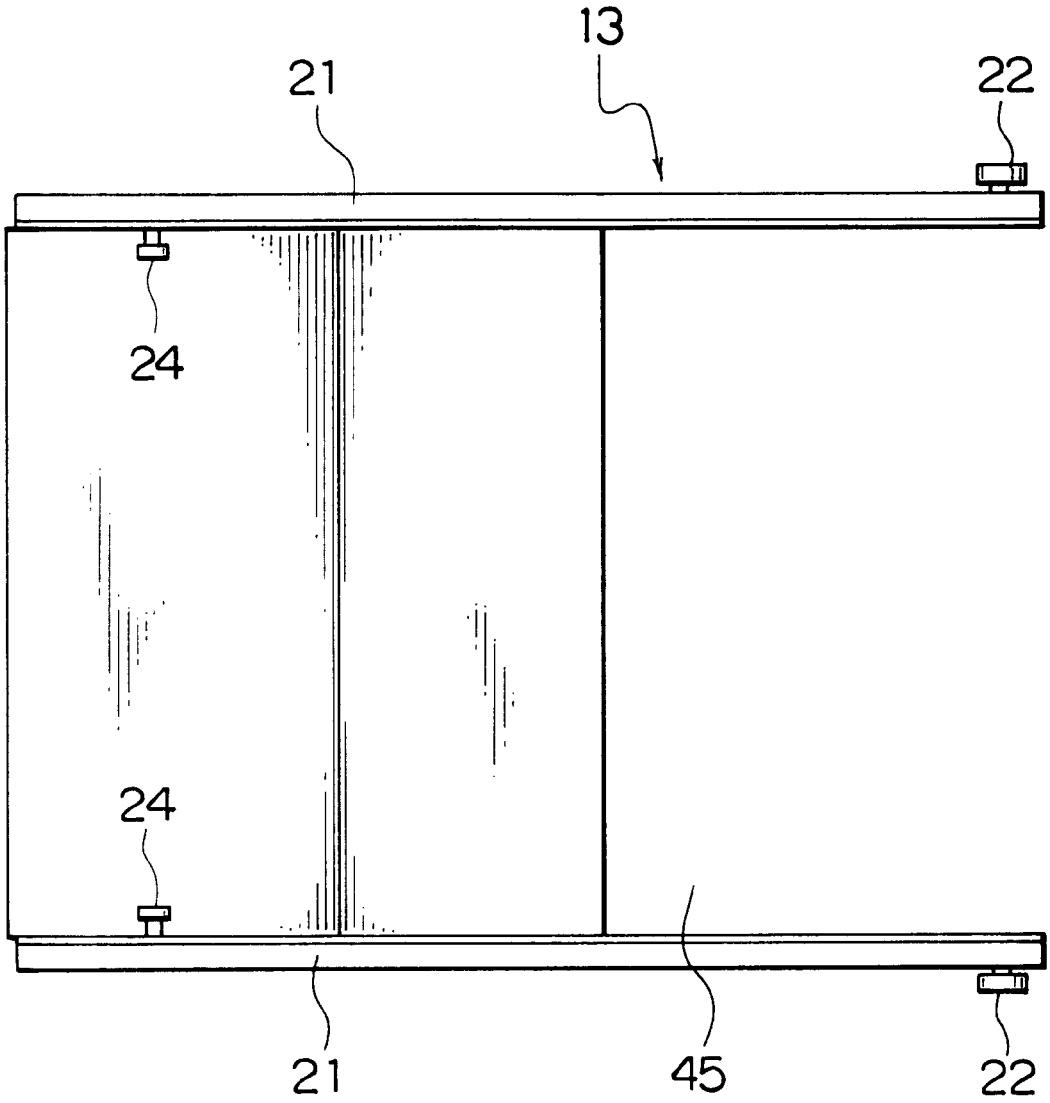
FIG. 6 is a plan view of a slide member included in the commodity storage apparatus of FIG. 5.

With reference to FIGS. 5 and 6, the description will be made as regards a commodity storage apparatus according to a second embodiment of the invention. In the illustration of FIGS. 5 and 6, the same reference numerals are used for representing the same or similar parts and elements in the previous embodiment shown in FIGS. 1 to 4.

The commodity storage apparatus of FIGS. 5 and 6 comprises a plurality of guide grooves 14 and 15 for each of the side plates 11, a plurality of commodity shelves 12, and a plurality of slide members 13. The slide members 13 are arranged in the vertical direction to be spaced with one another. The commodity shelves 12 are placed over the slide members 13, respectively.

Each of the slide members 13 has a bottom surface on the front end portion only and an insertion portion 45 on the rear end portion so that the rear end of the other shelf 12 of the lower position can be inserted into the insertion portion 45. In other words, the commodity shelves 12 are arranged in an up and down configuration in such a manner that the rear end portions of the shelves of lower positions can be inserted into, or received by, the insertion portions 45 of the slide members 13, as illustrated in FIG. 5. This permits to make the space between the adjacent shelves 12 to be narrower so that the entire size of the apparatus can be made smaller in a vertical direction.

As described above, when each commodity shelf 12 is drawn in the forward direction for the purpose of supplement of the commodities 44, the rear portion of the shelf 12 is descended or lowered to a horizontal position. Therefore, an easy supplement operation of the commodities 44 can be attained. In this case, the weight of the commodity shelf 44 does not affect at all in the inclined direction (that is, toward the working personnel standing in front of the apparatus). Therefore, the drawing and restoring of the shelf 12 for commodity supplementing operations can be achieved with a small force by a working personnel, so that an efficient working can be attained. Further, additional advantage can be expected by the structure that the space between the adjacent commodity shelves is made narrower, so that the entire size of the apparatus can be made smaller in the vertical direction.

While the present invention has thus far been described in connection with a few embodiments thereof, it will readily be possible for those skilled in the art to put this invention into practice in various other manners. For example, the present invention is applicable to a commodity storage apparatus in which commodities are housed in the shelf to have a modified relation different from the fore and aft alignment relation.

What is claimed is:

1. A commodity storage apparatus for storing commodities, comprising:

an apparatus frame fixedly installed;

a shelf supported by said apparatus frame for housing said commodities, said shelf having a front end portion and a rear end portion and being movable between a forward position and a backward position; and attitude control means connected to said apparatus frame and said shelf and responsive to movement of said shelf between said forward and said backward positions for controlling an attitude of said shelf in a predetermined plane extending in a forward and rearward direction and a vertical direction, said attitude control means comprising:

front guiding means coupled to said apparatus frame and said shelf for guiding said front end portion of the shelf in said forward and rearward direction in accordance with said movement of the shelf; and rear guiding means coupled to said apparatus frame and said shelf for guiding said rear end portion of the shelf so that said rear end portion moves between a relatively higher position and a relatively lower position in accordance with said movement of the shelf, said front guiding means comprising:

a slide member coupled to said apparatus frame to be movable in said forward and rearward direction; and pivotal support means connected to said shelf and said slide member for pivotally supporting said front end portion of the shelf on said slide member.

2. A commodity storage apparatus as claimed in claim 1, wherein said rear guiding means guides said rear end portion of the shelf in an oblique direction intersecting said forward and rearward direction and said vertical direction.

3. A commodity storage apparatus as claimed in claim 2, wherein said rear guiding means comprises:

a guide groove portion coupled to said apparatus frame and having a part extending in said oblique direction; and a guided member connected to said rear end portion of the shelf and inserted in said guide groove portion.

4. A commodity storage apparatus as claimed in claim 3, wherein said guided member comprises a roller rotatably attached to said rear end portion.

5. A commodity storage apparatus as claimed in claim 1, wherein said pivotal support means comprises:

a coupling plate fixed to said front end portion of the shelf; and a pin fixed to said slide member and pivotally engaged with said coupling plate.

6. A commodity storage apparatus as claimed in claim 3, wherein said front guiding means further comprises:

a guide projection connected to said slide member and extending in said forward and rearward direction; and a roller rotatably attached to said apparatus frame and supporting said guide projection thereon.

7. A commodity storage apparatus as claimed in claim 5, wherein said front guiding means further comprises:

a guide rail connected to said apparatus frame and extending in said forward and rearward direction; and a roller rotatably attached to said slide member and supported on said guide rail.

8. A commodity storage apparatus as claimed in claim 1, further comprising a stopper connected to said apparatus frame for stopping said shelf at said backward position.

9. A commodity storage apparatus comprising:

a shelf for housing commodities in a back and forth alignment relation;

an apparatus frame supporting said shelf in a forwardly inclined relation, said shelf being drawable in a forward direction of said apparatus frame;

attitude control means connected to said shelf and said apparatus frame and responsive to movement of said shelf in said forward direction for controlling an attitude of said shelf in such a manner that a rear end of said shelf is descended when said shelf is moved in a forward direction and that said rear end of the shelf is ascended when said shelf is moved in a backward direction;

a slide member supported movably in said forward and said backward directions, a front end of said shelf being pivotally engaged with a front end of said slide member, and rear guiding means movably coupled to said apparatus frame for guiding said rear end of the shelf, said rear guiding means having at least a rear end portion which is inclined downwardly in said forward direction.

10. A commodity storage apparatus according to claim 9, further comprising an additional shelf placed lower than the first-mentioned shelf for housing commodities in said back and forth alignment relation, said slide member having an insertion portion at a rear portion thereof, said additional shelf having a part which is placed in said insertion portion.

* * * * *

UNITED STATES PATENT AND TRADEMARK OFFICE

CERTIFICATE OF CORRECTION

PATENT NO. : 6,199,965 B1
DATED : March 13, 2001
INVENTOR(S) : Tooru Kanbe et al.

It is certified that error appears in the above-identified patent and that said Letters Patent is hereby corrected as shown below:

Column 6,
Line 32, delete "3" and insert -- 5 --.

Signed and Sealed this

Third Day of June, 2003

JAMES E. ROGAN
*Director of the United States Patent and Trademark Office*